US006040657A

United States Patent [19]

Vrescak et al.

[11] Patent Number: 6,040,657

[45] Date of Patent: Mar. 21, 2000

[54] THIN FACEPLATE IMAGE INTENSIFIER TUBE HAVING AN IMPROVED VACUUM HOUSING

[75] Inventors: Warren David Vrescak, Roanoke; Daniel Brown Vest, Check; Nils Ian Thomas, Roanoke; Thomas N. Peck, Roanoke; Thomas Mabry, Roanoke, all of Va.

[73] Assignee: ITT Manufacturing Enterprises, Wilmington, Del.

[21] Appl. No.: 08/911,755

[22] Filed: Aug. 15, 1997

[51] Int. Cl.[7] ..... H01J 31/50

[52] U.S. Cl. ..... 313/544; 313/530; 313/528; 250/214 VT

[58] Field of Search ..... 313/542, 544, 313/103 R, 530, 103 CM, 524, 528; 250/214 VT

[56] References Cited

U.S. PATENT DOCUMENTS

| | | | |
|---|---|---|---|
| 3,567,947 | 3/1971 | Robbins | 313/105 CM |
| 3,904,065 | 9/1975 | Shrader | 313/524 |
| 3,951,698 | 4/1976 | Wilson et al. | 313/528 |
| 4,296,073 | 10/1981 | Freeman et al. | 313/105 CM |
| 4,628,198 | 12/1986 | Giorgi | 205/214 VT |
| 5,369,267 | 11/1994 | Johnson et al. | 205/214 VT |
| 5,510,673 | 4/1996 | Wodecki et al. | 205/214 VT |
| 5,514,928 | 5/1996 | Niewold | 313/105 CM |

*Primary Examiner*—Michael H. Day
*Attorney, Agent, or Firm*—Arthur L. Plevy

[57] ABSTRACT

An improved image intensifier tube has electrically operative components that include a photocathode having a photoemissive layer, a microchannel plate (MCP) having a conductive input surface and a conductive output surface, and a vacuum housing for retaining the photocathode, microchannel plate and a fiber optic inverter and screen within an evacuated environment. The fiber optic inverter has a circumferentially extending flange portion extending toward the housing to accommodate a sealing material which sealingly engages an inner surface of an output flange with the inverter flange portion to form an air impervious vacuum seal and where the output flange is supported by the fiber optic inverter flange portion. The improved intensifier includes a photocathode having a flat faceplate conductively engaging the photocathode along the entire surface of the faceplate. The photocathode is operable so as to directly engage a conductive support ring for providing electrical contact to the photocathode external to the vacuum housing. The improved intensifier further includes a support assembly disposed in the housing for supporting the microchannel plate. The assembly includes a ceramic ring having a first metalized surface in conductive contact with the microchannel plate and a second metalized surface operable to provide an electrical contact external to the housing, and where the ceramic ring is soldered to the plate at a position on the first metalized surface to conductively join and retain the plate within the housing. A non-evaporable getter is disposed in the housing between the metalized ceramic ring and a getter tab to absorb gas generated during operation of the image intensifier tube.

21 Claims, 7 Drawing Sheets

THIN FACEPLATE IMAGE INTENSIFIER TUBE HAVING AN IMPROVED VACUUM HOUSING

CROSS-REFERENCE TO RELATED APPLICATIONS

The present application is related to copending commonly assigned patent application, Ser. No. 08/899,725, filed on Jul. 24, 1997 by Thomas, et al., entitled "Light Weight/Small Image Intensifier Tube", incorporated herein by reference.

FIELD OF THE INVENTION

The invention relates to improvements in image intensifier tubes of the type used in night vision equipment and, more particularly, to proximity focused image intensifiers having an improved faceplate with a flat surface and a vacuum housing structure having a metalized ceramic soldered to a microchannel plate to retain the plate for reduced device size and weight.

BACKGROUND OF THE INVENTION

Image intensifier devices multiply the amount of incident light they receive and provide an increase in light output, which can be supplied either to a camera or directly to the eyes of a viewer. Image intensifiers are constructed for a variety of applications and hence vary in both shape and size, with proximity focused image intensifiers comprising a particular type of image intensifier having the smallest size and weight of all categories of image intensifiers. These devices are particularly useful for providing images from dark regions and have both industrial and military applications. For example, image intensifiers are used in night vision goggles for enhancing the night vision of aviators and other military personnel performing covert operations. They are employed in security cameras and in medical instruments to help alleviate conditions such as retinitis pigmentosis (night blindness). Such an image intensifier device is exemplified by U.S. Pat. No. 5,084,780 entitled TELESCOPIC SIGHT FOR DAY/NIGHT VIEWING by Earl N. Phillips issued on Jan. 28, 1992 and assigned to ITT Corporation the assignee herein.

Image intensifiers include active elements, support elements and supply elements. The active elements include the photo-cathode (commonly called simply "cathode"), microchannel plate (MCP), phosphor screen (screen), and getter. The cathode detects a light image and changes the light image into an electron image. The MCP amplifies the electron image and the screen changes the electron image back to an light image. The getter absorbs gas which is generated during operation of the tube.

The support elements comprise the mechanical elements which physically support the active elements of the tube. In a standard proximity focused tube these support elements are the vacuum envelope (known as the body), input faceplate (sometimes also called "cathode"), and the output faceplate or fiber-optic (also called "screen").

The supply elements in the tube include the chrome contact that is deposited on the faceplate to the cathode, the screen aluminum contact which is deposited on the fiber-optic or output faceplate, and the metalizing on the MCP glass. In addition the metal parts in the body assembly also provide electrical contact.

Finally there are packing elements which perform other functions. The fiber-optics direct the image generated by the screen to a convenient position so that the system optics can properly direct the image to the ocular plane.

As is known, three major components of modern image intensifier tubes are the photocathode, phosphor screen (anode), and MCP disposed between the photocathode and anode. These three components are positioned within the evacuated housing or vacuum envelope, thereby permitting electrons to flow from the photocathode through the MCP and to the anode. In order for the image intensifier tube to operate, the photocathode and anode are normally coupled to an electric source whereby the anode is maintained at a higher positive potential than the photocathode. Similarly, the MCP is biased and operates to increase the density of the electron emission set forth by the photocathode. Furthermore, since the photocathode, MCP and anode are all held at different electrical potentials, all three components are electrically isolated from one another when retained within the vacuum housing.

Two major disadvantages are associated with the prior art image intensifiers. The first disadvantage concerns the interface with the image intensifier system, notably the objective lens and the eyepiece. The second disadvantage concerns the length and complexity of the tube and its housing, which causes problems particularly for user's of night vision goggles. The major interface problem with the present intensifier tubes is the input faceplate thickness which is typically 0.210" thick. The input faceplate is part of the optical elements included in the image intensifier tube's objective lens. As an optical element it introduces defects in the image called aberrations. These aberrations reduce the resolution and contrast of the system. The aberrations from the faceplate can be corrected by introducing more lens elements, increasing the index of refraction of the present elements, or using non-spherical curves in the elements. However, each of these approaches increases the weight and cost of the objective lens and thereby the system. In addition, if the optical path of the objective lens is folded by a mirror or prism, the thick faceplate can not be brought into proper focus.

The second interface problem is stray light reflecting off of the slope on the faceplate creating ghost images and lower contrast. In the prior art, this slope is required in the tube so that the photocathode, which is mounted on the resulting surface, is in focus for the MCP. Finally, in the case of night vision goggles, the total length of the tube pushes the objective lens in away from the head causing the user to perceive that the goggle system is heavier than its actual weight. Thus, shortening the length of the tube is highly desired.

The fundamental reasons that the tube is long in prior art devices are that while the cathode, MCP and screen must be in close proximity to each other to give a high resolution image, the high voltages required to operate the device must have a certain amount of physical path distance so that leakage or breakdown do not occur. Furthermore, ceramic parts and shields are added for supplying the getter for long product life. The ceramic spacers and hold down mechanisms for the MCP are also pivotal in extending tube length. They are required to hold the MCP in its position and provide the electrical energy to the plate without breakdown. As a result the sloped section of the faceplate is required to place the cathode in proximity to the MCP so that a chrome contact must be used. This requires additional metallization deposition steps for fabricating the image intensifier. These parts add approximately 0.09" in tube length. The need for a getter to absorb the gas adds approximately 0.06" in length to the tube. These and other miscellaneous requirements yield a tube length of approximately 0.7" long.

In view of the prior art, there exists a need for an improved image intensifier tube having a thin flat faceplate to reduce optical aberrations caused by sloped cathodes as well as reducing tube length. The photocathode should directly contact the support ring to provide an electrical bias so as to eliminate the chrome metal deposition process for sloped photocathodes. Furthermore, an improved housing is desired which can further reduce tube length and retain and support the MCP while electrically isolating the photocathode, MCP and anode from one another.

SUMMARY OF THE INVENTION

An improved image intensifier tube has electrically operative components that include a photocathode having a photoemissive layer, a microchannel plate (MCP) having a conductive input surface and a conductive output surface, and a vacuum housing for retaining the photocathode, microchannel plate and a fiber optic inverter within an evacuated environment. The fiber optic inverter has a phosphor screen for receiving electrons emitted by the cathode and converts the electrons into a visual image. The fiber optic inverter has a circumferentially extending flange portion extending toward the housing to accommodate a sealing material which sealingly engages an inner surface of an output flange with the inverter flange portion to form an air impervious vacuum seal and where the output flange is supported by the fiber optic inverter flange portion. The improved intensifier includes a photocathode having a flat faceplate conductively engaging the photocathode along the entire surface of the faceplate. The photocathode is operable so as to directly engage a conductive support ring for providing electrical contact to the photocathode external to the vacuum housing. The improved intensifier further includes a support assembly disposed in the housing for supporting the microchannel plate. The assembly includes a ceramic ring having a first metalized surface in conductive contact with the microchannel plate and a second metalized surface operable to provide an electrical contact external to the housing, and where the ceramic ring is soldered to the plate at a position on the first metalized surface to conductively join and retain the plate within the housing.

BRIEF DESCRIPTION OF THE DRAWINGS

The invention is to be explained in more detail below based on embodiments depicted in the following figures where.

DETAILED DESCRIPTION OF THE INVENTION

Figure 1:
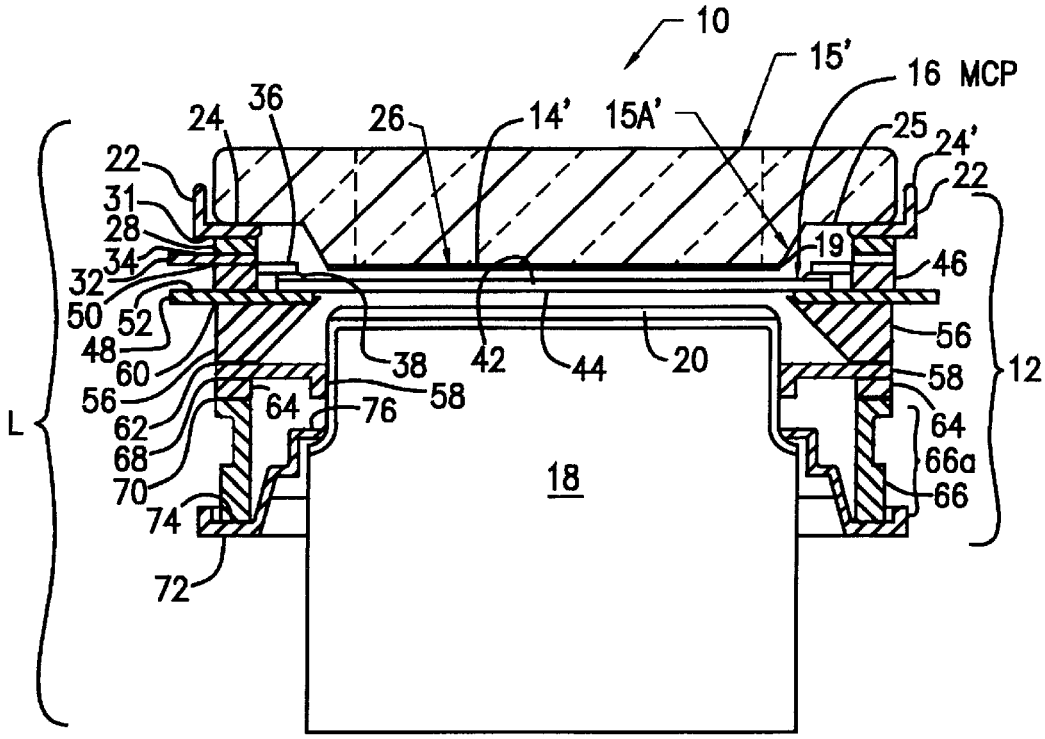
(PRIOR ART) FIG. 1
FIG. 1 is a cross sectional view of a prior art image intensifier tube.

Referring to FIG. 1, there is shown a cross-sectional view of a conventional prior art Gen III image intensifier tube 10 of the type currently manufactured by ITT Corporation, ElectroOptical Products Division of Roanoke, Va. The prior art Gen III image intensifier tube 10 includes an evacuated housing 12 made from the assemblage of several separate components. Within the housing 12 is positioned a photocathode 14', microchannel plate (MCP) 16, and an inverting fiber optic element 18, which supports a phosphor screen 20. The construction for the vacuum housing 12 usually includes at least eighteen separate elements stacked atop one another and joined so as to form an air tight envelope between the photocathode 14' and the fiber optic element 18.

The photocathode 14' is attached to a faceplate 15' having a sloped portion 15A' and a flat portion 24' which rests upon a conductive support ring 22 at one end of the vacuum housing 12. A metalized layer 25, generally chrome, is deposited upon flat portion 24' to conductively engage support ring 22. Metalized layer 25 extends continuously along sloped portion 15A' to conductively engage both the photocathode 14' and faceplate 15' at the interface 19. The abutment of the photocathode faceplate against the support ring 22 creates a seal to close one end of the vacuum housing 12. The support ring 22 contacts metalized surface 24' on the faceplate of the photocathode 14'. The metalized surface 24', in turn, is coupled to a photoresponsive layer 26 by means of the chrome deposited layer 25 on the photocathode 14' contained within the evacuated environment of the vacuum housing 12. As such, an electrical bias can be applied to the photoresponsive layer 26 of the photocathode 14' within the evacuated environment by applying an electrical bias to the support ring 22 on the exterior of the vacuum housing 12.

A first annular ceramic spacer 28 is positioned below the support ring 22. The first ceramic spacer 28 is joined to the support ring 22 by a first copper brazing ring 30 which is joined to both the first ceramic spacer 28 and the support ring 22 during a brazing operation. The brazing operation thereby creates an air impervious seal between the support ring 22 and first ceramic spacer 28. An upper MCP terminal 32 is joined to the first ceramic spacer 28, opposite support ring 22. The upper MCP terminal 32 is also joined to the first ceramic spacer 28 in a brazing operation, as such, a second brazing ring 34 is interposed between the upper MCP terminal 32 and the first ceramic spacer 28. The upper MCP terminal 32 extends into the vacuum housing 12 where it conductively engages a metal hold down ring 36 and a metal contact ring 38. The metal contact ring 38 engages the conductive upper surface 42 of the MCP 16 while the hold down ring retains it within the housing. Consequently, an electrical bias can be applied to upper surface 42 of the MCP 16 by applying the electrical bias to the upper MCP terminal 32 on the exterior of the vacuum housing 12.

A second ceramic spacer 46 is positioned below the upper MCP terminal 32, isolating the upper MCP terminal 32 from a lower MCP terminal 48. The second ceramic spacer 46 is brazed to both the upper MCP terminal 32 and the lower MCP terminal 48, as such a second brazing ring 50 is interposed between the upper MCP terminal 32 and second ceramic spacer 46 and a third brazing ring 52 is interposed between the second ceramic spacer 46 and the lower MCP terminal 48. The lower MCP terminal 48 extends into the vacuum housing 12 and engages the lower conductive surface 44 of the MCP 16. As such, the lower conductive surface 44 of the MCP 16 can be coupled to ground by connecting the lower MCP terminal 48 to a ground potential external of the vacuum housing 12.

A third ceramic spacer 56 separates the lower MCP terminal 48 from a getter shield 58. The third ceramic spacer is brazed to both the lower MCP terminal 48 and the getter shield 58. As such, a fifth brazing ring 60 is interposed between the lower MCP terminal 45 and the third ceramic spacer 56. Similarly, a sixth brazing ring 62 is interposed between the third ceramic spacer 56 and the getter shield 58.

A fourth ceramic spacer 64 is positioned below the getter shield 58, separating the getter shield from the output screen support 66. The fourth ceramic spacer is brazed to both the getter shield 58 and the output screen support 66. As such, seventh and eighth brazing rings 68 and 70 are positioned above and below the fourth ceramic spacer 64, respectively.

The lower end of the vacuum housing 12 is sealed by the presence of an output screen flange 72. The output screen flange 72 is joined to both the output screen support 66 and the fiber optic element 18. A first seal 74 occurs at the point where the output flange 72 is joined to screen support 66. A second first seal 76 occurs at the location where flange 72 joins the fiber optic element 18. The combination of the three seals (74, 76, and 22) thus forms an air tight envelope defined by the vacuum housing 12 in between the photocathode 14 and the fiber optic element 18, whereby the vacuum housing 12 is constructed by numerous stacked components joined together in an air impervious manner.

In the prior art embodiment of FIG. 1, the sloped faceplate portion of the photocathode 14' positions the cathode in proximity to the MCP 16 in order to yield a high resolution image while at the same time attempting to maintain separation via the ceramic spacers 28 and 46 and hold down mechanism (i.e. hold down ring 36, contact ring 38 and MCP support ring 48) to provide electrical energy to the plate without incurring voltage breakdown, arcing or electrical leakage. As such, if large differences in potential are applied to the support ring 22 and the upper MCP terminal 32, arcing or other electrical leakage may occur across the first ceramic spacer 28 on the exterior of the vacuum housing 12. Similarly, if large varied potentials are applied between the upper MCP terminal 32 and lower MCP terminal 48, similar arcing or other leakage may occur across the second ceramic spacer 46. Such leakage problems are particularly prevalent when using multiple stacked elements across the exterior of the vacuum housing 12 in humid environments. Furthermore, the prior art uses two seals in the housing design (reference numerals 74 and 76). Because of the multiple seals the unit is susceptible to vacuum leakages at either one or both of the seals. In addition, the length of the vacuum housing is extended as evidenced by the length 66A of screen support 66 required to seal both the output flange 72 and ceramic spacer 64 as well as maintain the tube in its fixture, thus yielding a tube length L of approximately 0.7" long.

Figure 2:
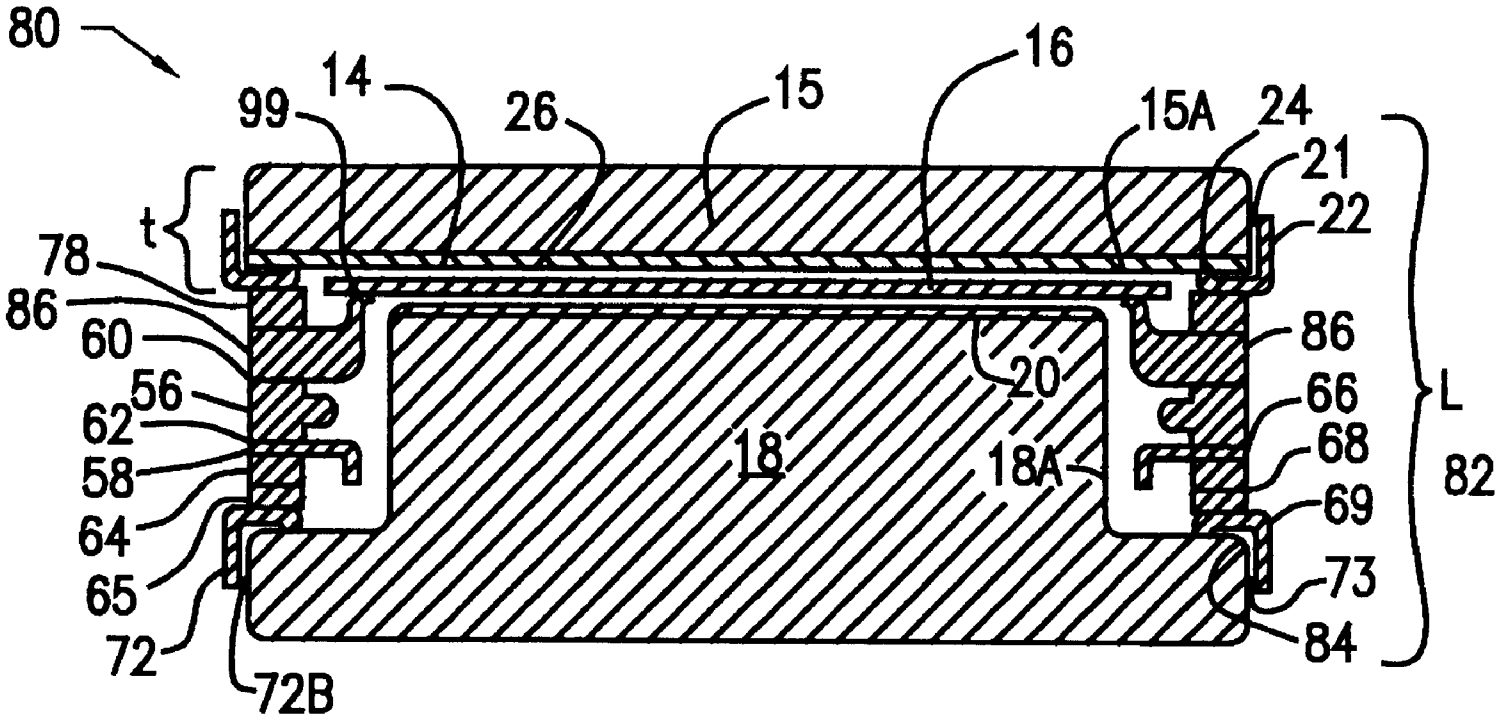
FIG. 2 is a cross sectional view of one preferred embodiment of the present invention image intensifier tube.

Referring now to FIG. 2, there is shown an image intensifier tube 80 embodying one preferred embodiment of the present invention vacuum housing 82 and photocathode 14. The photocathode 14 includes a faceplate 15 comprising a thin flat surface 15A and a thickness t ranging from as thin as 0.090". The thickness has been significantly reduced in the present invention from a typical dimension of 0.215" by eliminating the sloped portion of the photocathode in the prior art and moving the entire MCP support mechanism forward within the tube (i.e. reducing the length defining the vacuum housing 82). The thin faceplate introduces less optical aberrations into the image intensifier 80 so that the objective lens (not shown) requires less corrective elements, enabling it to be of lighter weight. Depending on the particular application, thin glass faceplates having thicknesses ranging from 0.090" to 0.210" are used. The thinner faceplate permits the objective lens to be moved closer to a user's head for head-mounted applications such as night vision goggles. Thus, the center of gravity of the goggle moves closer to the user's normal center of gravity. The thin faceplate also permits additional elements to be added without exceeding a given weight constraint, such as the use of fold mirrors or prisms to further enhance the optical characteristics of the device.

Referring again to FIG. 2, the flat photocathode 14 rests upon conductive support ring 22 at one end of the vacuum housing 82. The abutment of the photocathode 14 against the support ring 22 creates a recess which is filled with a sealing material 21 to close one end of the vacuum housing 12. In the preferred embodiment, the sealing material is indium. The support ring 22 directly contacts the face of the photocathode 14 at surface position 24. The surface 24, in turn, is coupled to a photoresponsive layer 26, on the photocathode 14 that is contained within the evacuated environment of the vacuum housing 12. As such, an electrical bias can be applied to the photoresponsive layer 26 of the photocathode 14 within the evacuated environment by applying an electrical bias to the support ring 22 on the exterior of the vacuum housing 82.

In the prior art, a layer 25 (FIG. 1) of chrome conductively joined the faceplate with the photocathode. FIG. 1 shows that in order to provide electrical contact at the support ring, chrome layer 25 is deposited along both the sloped portion 15A' and surface 24' of the photocathode faceplate so that the photocathode is in electrical communication with the terminal support ring 22. In the present invention, the flat photocathode faceplate is still attached to the photocathode 14, however, the photocathode extends to the seal area to directly engage conductive support ring 22. In this manner, electrical contact is made directly to the tube envelope or housing 82 at support ring 22 instead of through a chrome contact layer, as in the prior art. Therefore, the time-consuming and costly step of thin-film chrome deposition during the image intensifier fabrication process is eliminated.

Referring again to FIG. 2, the vacuum housing 82 is formed to retain the photocathode 14, a microchannel plate 16 and a phosphor screen 20 deposited on a fiber optic inverter element 18. The inverter element 18 has a circumferentially extending flange portion 84 defining the lower end of the vacuum housing. A metalized ceramic ring 86 is soldered to the MCP at reference numeral 99 to retain the MCP within the housing, providing both electrical conductivity and structural support thereto while preventing any axial or lateral displacement of the MCP. A ceramic spacer ring 78 is positioned below support ring 22 and above metalized ceramic ring 86. Ceramic spacer ring 78 is joined to both the support ring 22 and metalized ceramic ring 86 during a brazing operation. The brazing operation creates an impervious seal at a first position between the support ring 22 and ceramic spacer ring 78 and at a second position between the metalized ceramic ring 86 and ceramic spacer ring 78. Ceramic spacer 56 separates the MCP supportive metalized ceramic ring 86 from getter shield 58. This ceramic spacer is brazed to both the metalized ceramic ring and the getter shield via two additional brazing rings 60 and 62. Ceramic spacer 64 is positioned below getter shield 58, separating the getter shield from the getter tab 65. Brazing rings 66 and 68 are positioned above and below ceramic spacer 64, respectively.

The lower end of vacuum housing 82 is sealed by metal output screen flange 72. Output screen flange 72 is joined to getter tab 65 via brazing ring 69 and to fiber optic element 18 via an indium sealing material 73. Fiber optic element 18 comprises a first portion 18A of uniform circumference and a second circumferentially extending flange portion 84 extending toward the housing and engaging inner surface 72B of output flange 72. The output flange 72 thus rests against and is supported by circumferentially extending portion 84. An indium compound 73 joins the output flange 72 with inverter 18 to seal the vacuum housing constructed by each of the stacked components in an air impervious manner. As is known in the art, getter tab 65 is operable to hold the tube in its fixture by means of a series of tabs (not shown) extending radially from the getter tab ring 65.

Figure 3:
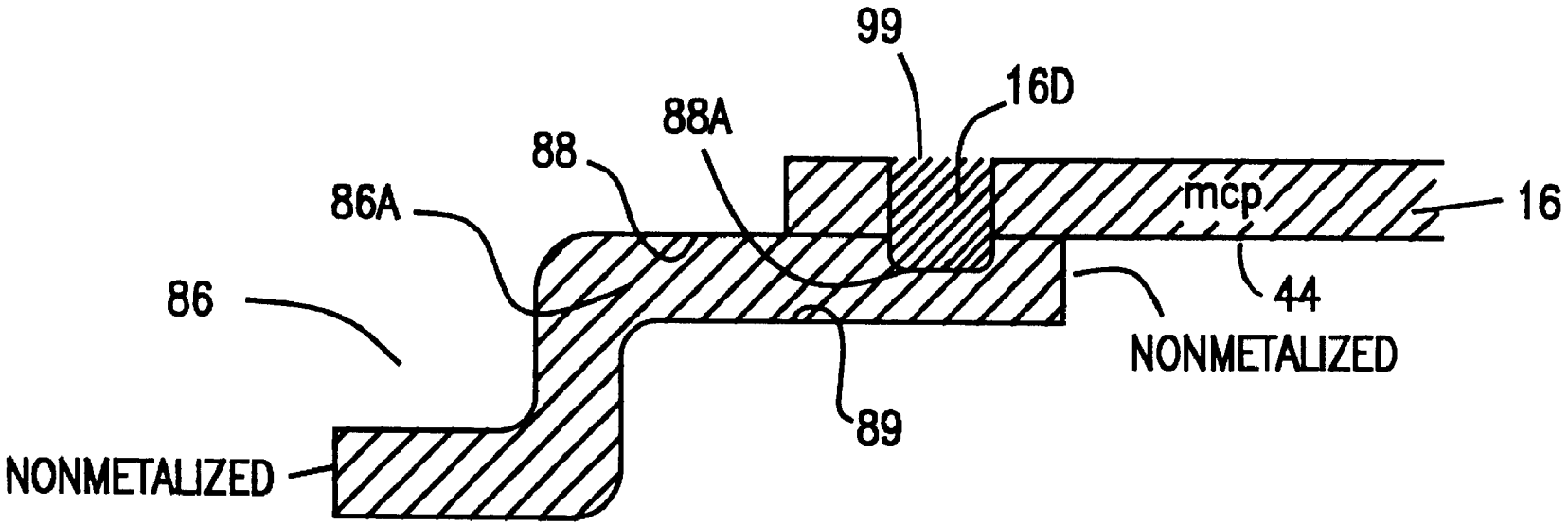
FIG. 3 is an enlarged cross sectional view of the embodiment of FIG. 2.

Referring now to FIG. 3 in conjunction with FIG. 2, FIG. 3 represents an exploded view of the metalized ceramic ring 86 for retaining MCP 16. With respect to FIG. 3 and all subsequent figures, like reference numerals have been used to designate the same parts as in FIGS. 1 and 2. In the preferred embodiment, metalized ceramic ring 86 includes a first metalized surface 88 in electrical contact with conductive lower surface 44 of the MCP. A second metalized surface 89 is electrically isolated from first metalized surface 88 by the ceramic portion 86A and brazed to ceramic spacer 56 (FIG. 2) by brazing ring 60. In this manner, a potential bias can be applied to the metalized surface to create voltage differences between the support ring 22 and the MCP 16 to permit electron flow at the photocathode and MCP. The second metalized surface 89 also provides electrical contact external to the housing to permit a potential source to be applied.

The metalized ceramic ring 86 is positioned entirely below the MCP 16 and in contact with the MCP only at the MCP lower surface contact layer 44 to provide axial support and terminal contact. Ceramic ring 86 includes metalized surface 88 having a recess 88A axially aligned with a cavity 16D of MCP 16. The recess 88A formed within ceramic ring 86 does not extend through to metalized surface 89. The recess 88A and cavity 16D are aligned so as to accommodate a solder pin 99 which fills both the cavity and recess to conductively join and laterally secure ceramic ring 86 to MCP 16. Thus, the MCP support comprises a metalized ceramic for the electrical contacts and the MCP is soldered onto the support surface 88A. This design is advantageous in that metalizing the monolithic ceramic support surfaces 88 and 89 eliminates two separate metal pieces from the stacked housing design. Furthermore, soldering the MCP to its support eliminates the mechanical retention mechanisms used in prior art to retain the MCP. As a result, the total tube length L may be reduced to approximately 0.4 inches, yielding a substantially smaller and lighter weight image intensifier tube. Moreover, the soldered joint doesn't weaken over the expected lifetime of the tube, as in prior art (i.e. non-solder) designs. Gold-tin, gold-germanium, tin, and copper are exemplary solder material alloys capable of withstanding the high temperature (exceeding 360 degrees) tube fabrication process and may be used to bond the MCP to its support structure. A number of other alloys in varying percentages and mixtures as is well known in the art may be used to join and support the MCP.

Figure 4:
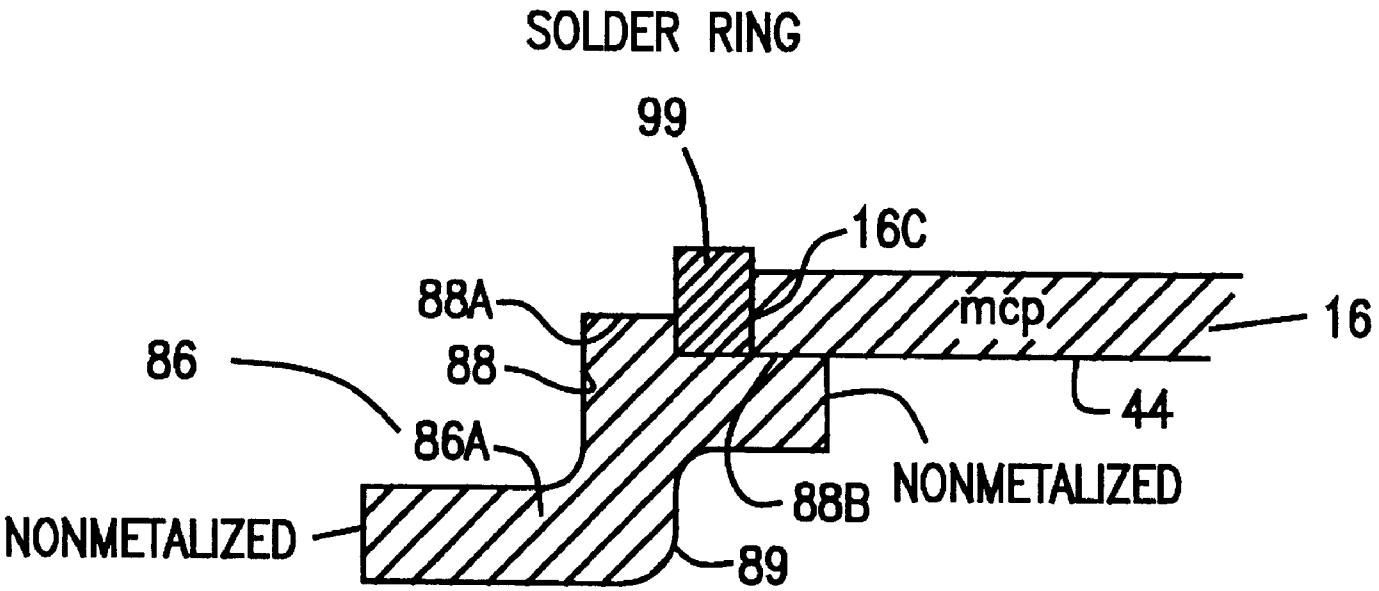
FIG. 4 is an enlarged cross sectional view of a second preferred embodiment of the metalized ceramic ring of the present invention image intensifier tube.

In an alternative embodiment illustrated in FIG. 4, the metalized ceramic ring 86 is positioned such that metalized surface 88 includes an axially extending tab portion 88A laterally aligned with surface 16C of the MCP and a laterally extending portion 88B conductively engaging MCP lower surface 44 in supportive arrangement. A recess or butt-type joint formed by the lateral displacement of tab portion 88A from MCP surface 16C is filled by solder ring 99 to conductively join and laterally secure metalized ceramic ring 86 to MCP 16.

Figure 5:
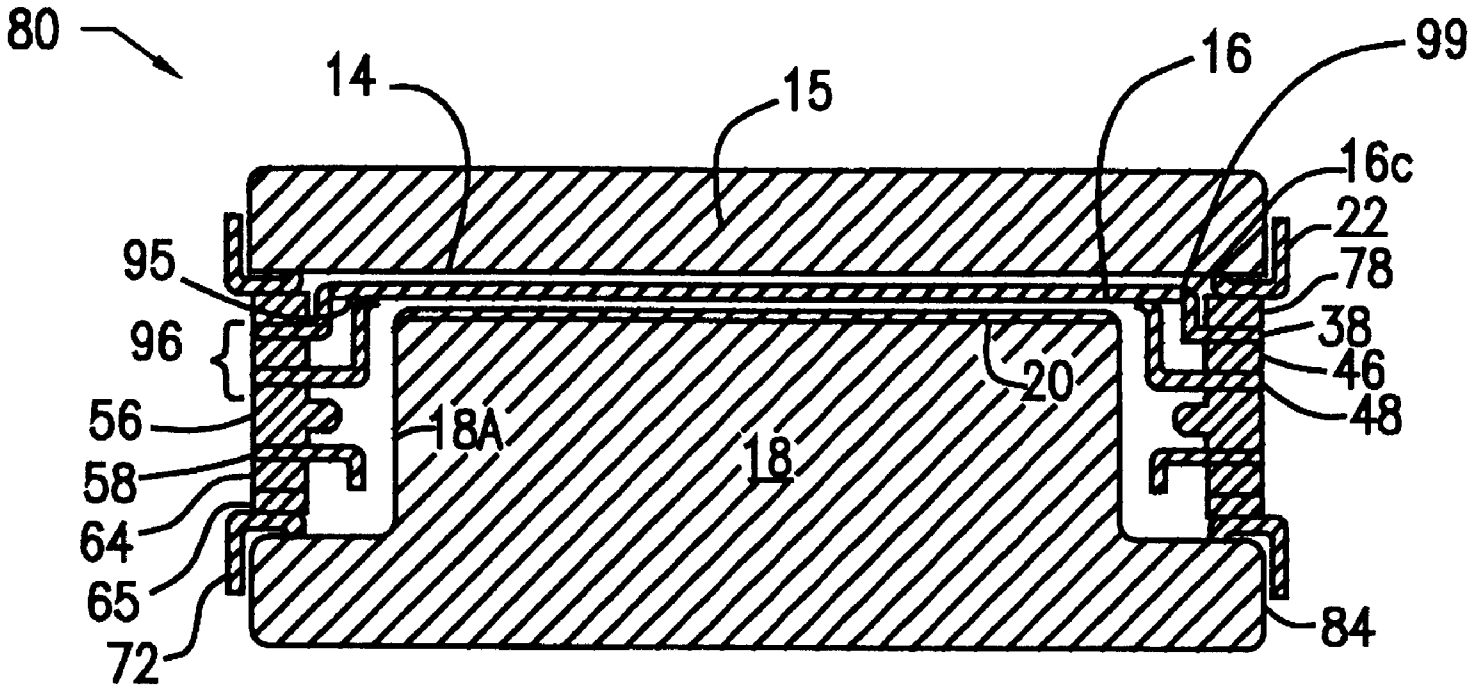
FIG. 5 is a cross sectional view of an alternative embodiment of the present invention.

In another embodiment illustrated in FIG. 5, the metalized ceramic ring 86 supporting the MCP is replaced by a support assembly 96 comprising a first conductive contact ring 38 conductively engaging MCP 16 at a point on MCP surface 16C. The recess formed by the abutment of the contact ring and MCP is filled by solder joint 99 to conductively join and laterally secure contact ring 38 to MCP 16. Ceramic spacer 46 is brazed to contact ring 38 and electrically isolates contact ring 38 from MCP lower support ring 48, which is brazed to ceramic spacer 46 opposite contact ring 38. MCP lower support ring 48 conductively engages the MCP at lower surface 44 and is soldered thereto at position 95 to provide axial support and terminal contact to the MCP.

Figure 6:
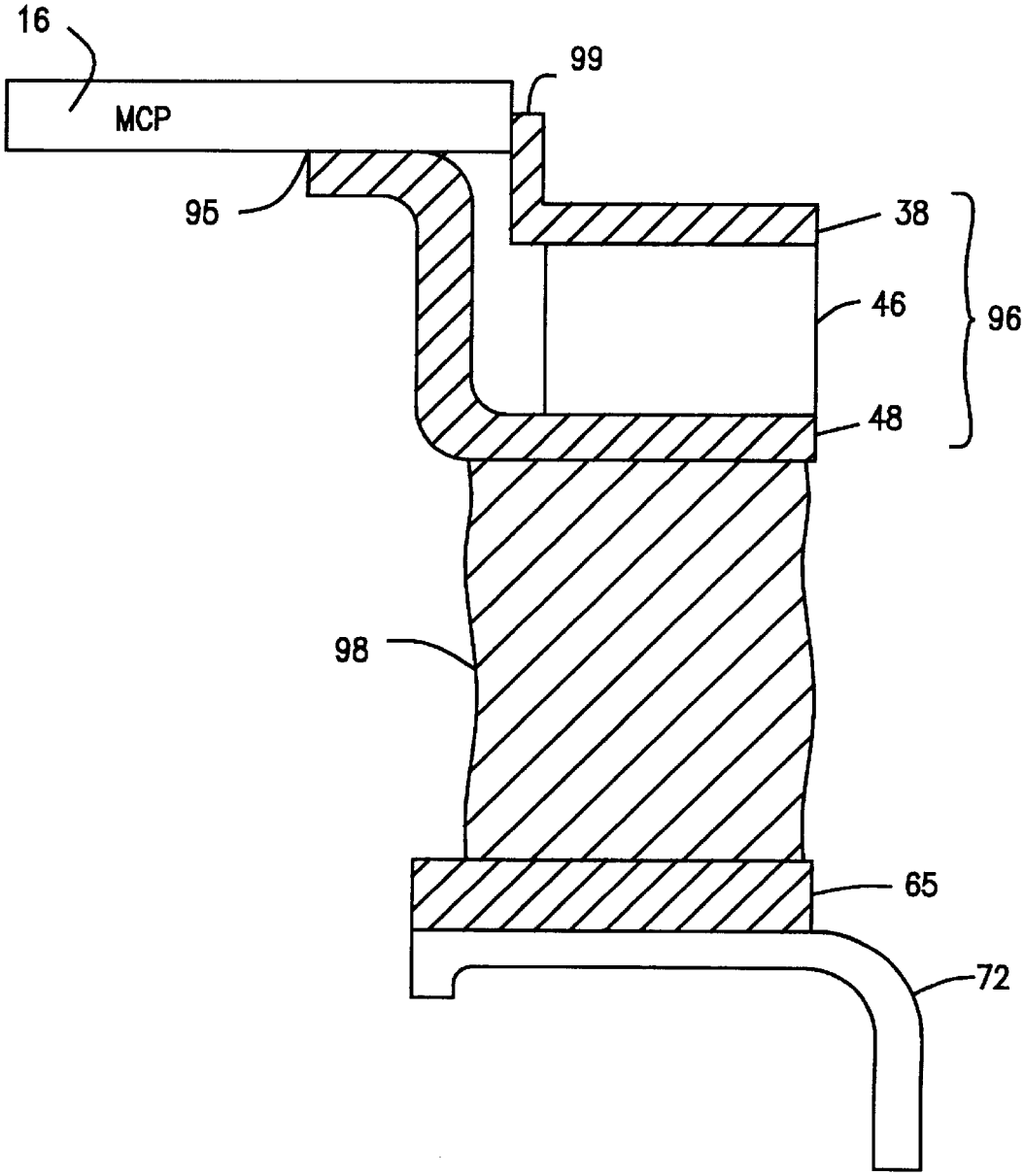
FIG. 6 is a cross sectional view of an embodiment of a non-evaporable getter in the present invention.
Figure 7:
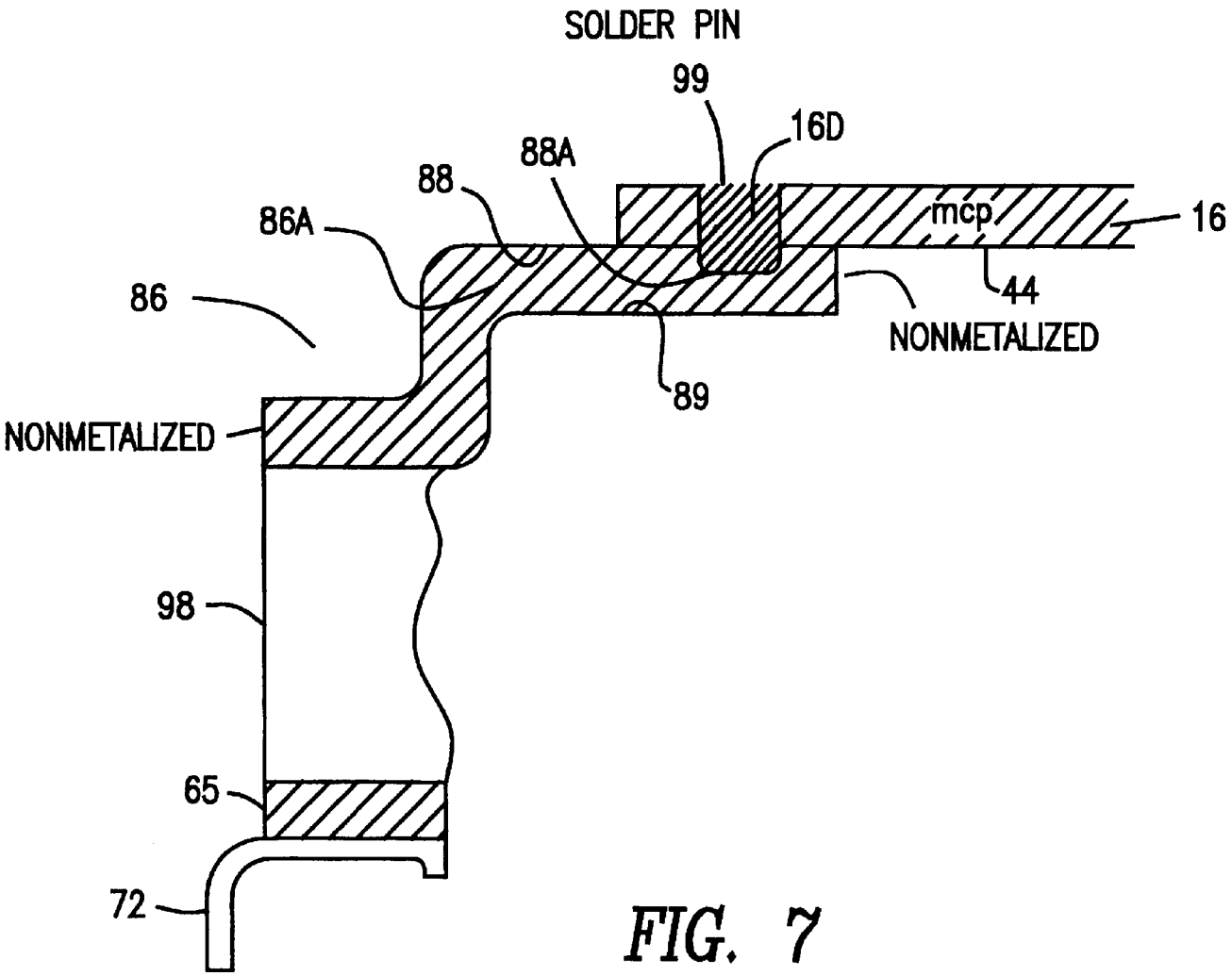
FIG. 7 is a cross sectional view of another embodiment of the non-evaporable getter within the present invention.

In another embodiment shown in FIG. 6, the image intensifier tube of the present invention may employ a non-evaporable getter 98 to absorb gas generated during operation of the tube. Incorporating a non-evaporable getter interposed between the MCP supporting mechanism and getter tab 65 permits the removal of getter ceramic 64, getter shield 58 and ceramic spacer 56 (FIG. 2), thereby further reducing the tube length. In addition to making a shorter tube, the non-evaporable getter 98 may provide greater gas absorbing capacity since parts having a larger surface area to volume ratio can be fabricated. Moreover, as is well known in the art, a non-evaporable getter does not require an electrical potential for reaction. The non-evaporable getter material may be made of a zirconium, vanadium, titanium or iron alloy of a proprietary mixture. FIG. 6 shows the non-evaporable getter in an image intensifier tube configuration employing the MCP supporting mechanism comprising a contact ring 38, ceramic spacer 46, support ring 48 configuration from FIG. 5, while FIG. 7 illustrates a similar configuration using the metalized ceramic ring 86 from FIGS. 2 & 3 as the MCP support.

The advantages of the present invention are manifold. First, as previously indicated, the thin faceplate allows the system optical designer to make a lighter objective lens as fewer aberrations exist in the thinner faceplate, requiring less corrections. Also, the thinner faceplate permits the objective lens to be moved closer to the user's head for head-mounted applications, thereby moving the device center of gravity closer to the user's normal center of gravity. Furthermore, use of the flat photocathode faceplate permits direct conductive contact with the seal at support ring 22, thereby eliminating the need to deposit a chrome contact layer used in the prior art along the surface and slope of the faceplate to bias the photocathode. This results in fewer tube processing steps and tube defects. Elimination of the slope further significantly reduces stray light introduced by the faceplate as any light that is reflected off the faceplate inner surface is now reflected to the exterior portion of the tube rather than into the active area.

The soldering of the MCP also has process advantages in that the process may be completely automated and performed in a batched mode instead of the manual serial process commonly used in prior art tube fabrication. Moreover, the entire periphery of the MCP (although not required) can be soldered to the metalized ceramic ring 86, thereby making a hermetic seal between the front end of the tube and the back end of the tube; therefore, sealing the periphery of the tube eliminates the potential that gas may escape and thereby increases tube reliability.

While there has been shown preferred embodiments of the present invention, those skilled in the art will further appreciate that the present invention may be embodied in other specific forms without departing from the spirit or central attributes thereof. The concept and central attributes embodying the invention could be used on any format tube, including non-Gen III image intensifier tubes. All such variations and modifications are intended to be within the scope of this invention as defined by the appended claims.

What is claimed is:

1. In an image intensifier tube having electrically operative components that include a microchannel plate (MCP) having an conductive input surface and a conductive output surface, retained within an evacuated environment of a vacuum housing, an improved photocathode having a photoemissive layer and a flat faceplate conductively engaging said photocathode along the entire surface of said faceplate, said flat faceplate and said photocathode in contact engagement only with a conductive support ring disposed in said vacuum housing for providing electrical contact to said photocathode external to said housing, wherein said conductive support ring is substantially aligned with a remainder of said vacuum housing.

2. The image intensifier of claim 1, further including a ceramic ring disposed in said housing for supporting said microchannel plate, said ceramic ring having a first metalized surface in conductive contact with said microchannel plate to enable application of a bias voltage for creating a potential difference between said MCP and said conductive support ring, and a second metalized surface opposite said first metalized surface to enable formation of an electrical contact external to said housing, wherein said ceramic ring is coupled to said plate at a position on said first metalized surface to conductively join and retain said plate within said housing.

3. An image intensifier of claim 2, wherein said first surface of said ceramic ring includes a radial tab portion and a laterally extending portion defining an edge, wherein said ceramic ring is coupled to said plate by means of a conductive ring interposed between an end of said microchannel plate and said edge of said first metalized surface of said metalized ceramic ring to define a butt-type joint wherein said conductive ring conductively joins said MCP and said ceramic ring at said joint.

4. The image intensifier of claim 2, wherein said ceramic ring includes a recess within said first metalized surface axially aligned with a cavity of said MCP to accommodate a solder pin, wherein said solder pin is positioned to fill said cavity and said recess to conductively join said ceramic ring to said MCP.

5. The image intensifier of claim 4, wherein said ceramic ring is positioned below said MCP along the entire length of its surface and conductively engaging said MCP at a position on said lower conductive surface of said MCP to provide axial structural support to said MCP.

6. The image intensifier of claim 1, wherein said flat faceplate is glass having a thickness of between 0.090 and 0.210 inches.

7. The image intensifier of claim 1, further including a non-evaporable getter disposed in said housing and coupled at an upper surface to said metallized ceramic and to a getter tab ring at a lower surface to absorb gas generated during operation of said image intensifier tube.

8. The image intensifier of claim 1, further including a fiber optic inverter having a phosphor screen for receiving said electrons emitted by said cathode and converting said electrons into a visual image, said fiber optic inverter having a circumferentially extending flange portion extending toward said housing, said flange portion supportive of and in sealed engagement with an inner surface of an output flange of said housing by means of a sealing material, wherein an air impervious vacuum is formed at said seal within said housing.

9. In an image intensifier tube having electrically operative components that include a photocathode having a photoemissive layer, and a microchannel plate (MCP) having a conductive input surface and a conductive output surface, retained within an evacuated environment of an improved vacuum housing, the improvement comprising:

a ceramic ring located beneath said MCP and having a first metalized surface in conductive contact with said microchannel plate and a second metalized surface opposite said first metalized surface to enable formation of an electrical contact external to said housing, wherein said ceramic ring is soldered to said plate at a position on said first metalized surface to conductively join and retain said plate within said housing.

10. The image intensifier of claim 9, said photocathode further including a flat faceplate conductively engaging said photocathode along the entire surface of said faceplate, said photocathode operable to directly engage a conductive support ring disposed in said vacuum housing for providing electrical contact to said photocathode external to said housing.

11. The image intensifier of claim 10, wherein said flat faceplate is glass having a thickness of approximately 0.090 inches.

12. The image intensifier of claim 9, said ceramic ring first surface including a radial tab portion and a laterally extending portion defining an edge, wherein a solder ring conductively interposed between an end of said microchannel plate and said edge of said first metalized surface of said metalized ceramic ring to define a butt-type joint conductively joins said MCP and said ceramic ring at said joint.

13. The image intensifier of claim 9, wherein a solder pin conductively fills a recess in said ceramic ring first metalized surface and a cavity in said MCP axially aligned with said recess to conductively join said ceramic ring to said MCP.

14. The image intensifier of claim 9, further including a non-evaporable getter disposed in said housing and coupled at an upper surface to said metallized ceramic and to a getter tab ring at a lower surface to absorb gas generated during operation of said image intensifier tube.

15. In an image intensifier tube having electrically operative components that include a photocathode having a photoemissive layer, and a microchannel plate (MCP) having a conductive input surface and a conductive output surface, retained within an evacuated environment of an improved vacuum housing, the improvement comprising:

a support assembly disposed in said housing for supporting said microchannel plate, said assembly including a metal contact ring in conductive contact with said microchannel plate at a first surface and a metal support ring in conductive contact with said microchannel plate at a second surface, an insulating ring disposed between said metal contact ring and said metal support ring and coupled thereto to electrically isolate said metal contact and support rings, wherein said metal contact ring is soldered to said plate at a position on said first surface and said support ring is soldered to said plate at a position on said second surface to conductively join and retain said plate and to provide electrical contacts thereto.

16. The image intensifier of claim 15, said photocathode further including a flat faceplate conductively engaging said photocathode along the entire surface of said faceplate, said photocathode operable to directly contact a conductive support ring disposed in said vacuum housing for providing electrical communication to said photocathode external to said housing.

17. The image intensifier of claim 16, wherein said flat faceplate is glass having a thickness of substantially 0.090 inches.

18. The image intensifier of claim 15, further including a non-evaporable getter for absorbing gas generated during operation of said image intensifier tube, said getter disposed in said housing and coupled to said metal support ring at an upper surface and to a getter tab ring at a lower surface.

19. In an image intensifier tube having electrically operative components that include a photocathode having a photoemissive layer, and a microchannel plate (MCP) having a conductive input surface and a conductive output surface, retained within an evacuated environment of an improved vacuum housing, the improvement comprising:

a ceramic ring located beneath said MCP and having a first metalized surface in conductive contact with said microchannel plate and a second metalized surface opposite said first metalized surface to enable formation of an electrical contact external to said housing, wherein a solder pin conductively fills a recess in said ceramic ring first metalized surface and a cavity in said MCP axially aligned with said recess to conductively join said ceramic ring to said MCP.

20. In an image intensifier tube having electrically operative components that include a photocathode having a photoemissive layer, and a microchannel plate (MCP) having a conductive input surface and a conductive output surface, retained within an evacuated environment of an improved vacuum housing, the improvement comprising:

a ceramic ring located beneath said MCP and having a first metalized surface in conductive contact with said microchannel plate and a second metalized surface opposite said first metalized surface to enable formation of an electrical contact external to said housing, and a non-evaporable getter disposed in said housing and coupled at an upper surface to said metalized ceramic and to a getter tab ring at a lower surface to absorb gas generated during operation of said image intensifier tube.

21. The image intensifier of claim 20, further including a fiber optic inverter having a phosphor screen for receiving said electrons emitted by said cathode and converting said electrons into a visual image, said fiber optic inverter having a circumferentially extending flange portion extending toward said housing, said flange portion supportive of and in sealed engagement with an inner surface of an output flange of said housing by means of a sealing material, wherein an air impervious vacuum is formed at said seal within said housing, wherein an outer surface of said output flange is coupled to said getter tab ring.

* * * * *